US005716120A

United States Patent [19]

Hung

[11] Patent Number: 5,716,120

[45] Date of Patent: Feb. 10, 1998

[54] PROTECTIVE ELBOW PAD OR KNEE PAD WITH A WARNING LAMP SIGNAL DEVICE

[76] Inventor: Tien-Mou Hung, P.O. Box 90, Tainan City 704, Taiwan

[21] Appl. No.: 839,896

[22] Filed: Apr. 18, 1997

[30] Foreign Application Priority Data

May 23, 1996 [TW] Taiwan ..... 85207702

[51] Int. Cl.[6] ..... F21L 15/08

[52] U.S. Cl. ..... 362/103; 362/234; 362/253

[58] Field of Search ..... 362/103, 253, 362/234, 800, 806; 2/16, 24, 905

[56] References Cited

U.S. PATENT DOCUMENTS 5,488,361 1/1996 Perry ..... 362/103 X
5,594,954 1/1997 Huang ..... 2/24

*Primary Examiner*—Stephen F. Husar

[57] ABSTRACT

A protective elbow or knee pad with a warning lamp signal device includes a tubular pad, an upper lid and a warning lamp signal device. The upper lid is fixed on the tubular pad, containing the lamp signal device deposited in a hollow space defined by angle posts fixed on an inner surface of the upper lid, which has holes for for plural lamps and a switch to fit therein so as to be seen from outside when the lamps are lit and flash by pressing the switch with a pointed thing, and forming a warning signal during the night.

1 Claim, 8 Drawing Sheets

PROTECTIVE ELBOW PAD OR KNEE PAD WITH A WARNING LAMP SIGNAL DEVICE

BACKGROUND OF THE INVENTION

This invention concerns a protective elbow or knee pad with a warning lamp signal device, particularly easy to assemble and able to give out warning signal during the night to elevate safety of exercising or walking during the night.

As a city has prospered and high-rising buildings have been increasing, parks or green areas have decreased accordingly. So it is very common that children are playing in parks, on streets, on side walks, etc, exposing in latent danger with many, many vehicles running very fast near them. And parents will get them protective pads for elbows or knees so that they may play more safely and prevent hurt in exercise. However, if they should play during the night, especially on roller skating or on sliding boards, or on bicycle, risk of colliding with vehicles or walking persons may heighten a lot, in spite of wearing protective elbow or knee pads.

SUMMARY OF THE INVENTION

The purpose of the invention is to offer a protective elbow or knee pad with a warning lamp signal device having a simple structure to assemble and an excellent effect when used during the night.

A main feature of the invention is a warning lamp signal device deposited in an upper lid fixed on a tubular pad. The warning lamp signal device includes a case, a circuit board fixed in the case and a lid slidably closed on the case. The case is then deposited in the upper lid, which has a position space defined by plural angle posts. Plural lamps and a switch of the lamp signal device are fixed on the circuit board and then fit in holes of said upper lid to be seen from outside when the lamps are lit and flash with the switch turned on by pressing with a pointed thing.

BRIEF DESCRIPTION OF DRAWINGS

This invention will be better understood by referring to the accompanying drawings, wherein.

DESCRIPTION OF THE PREFERRED EMBODIMENT

Figure 1:
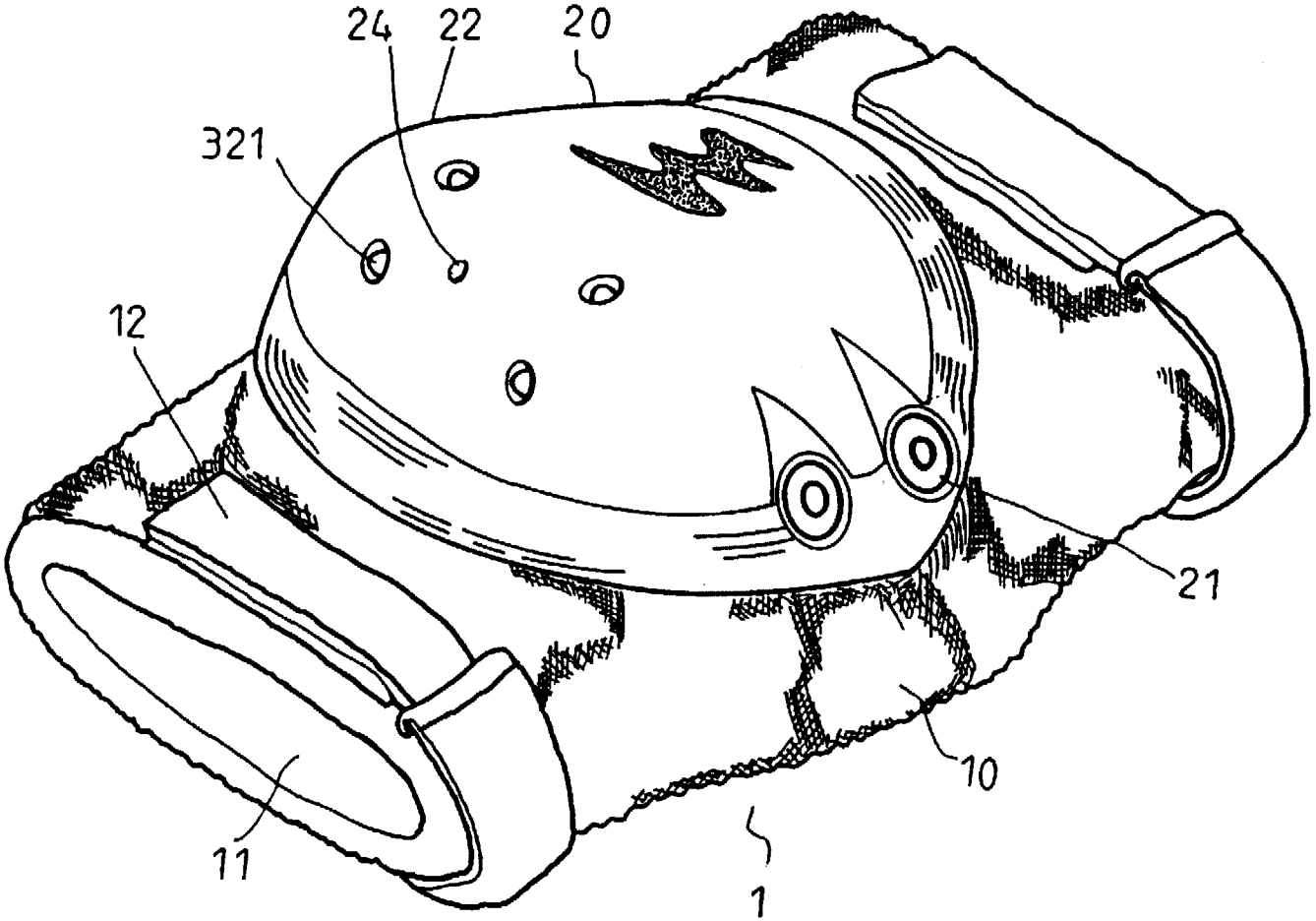
FIG. 1 is a perspective view of a preferred embodiment of a protective elbow pad with a warning lamp signal device in the present invention.
Figure 2:
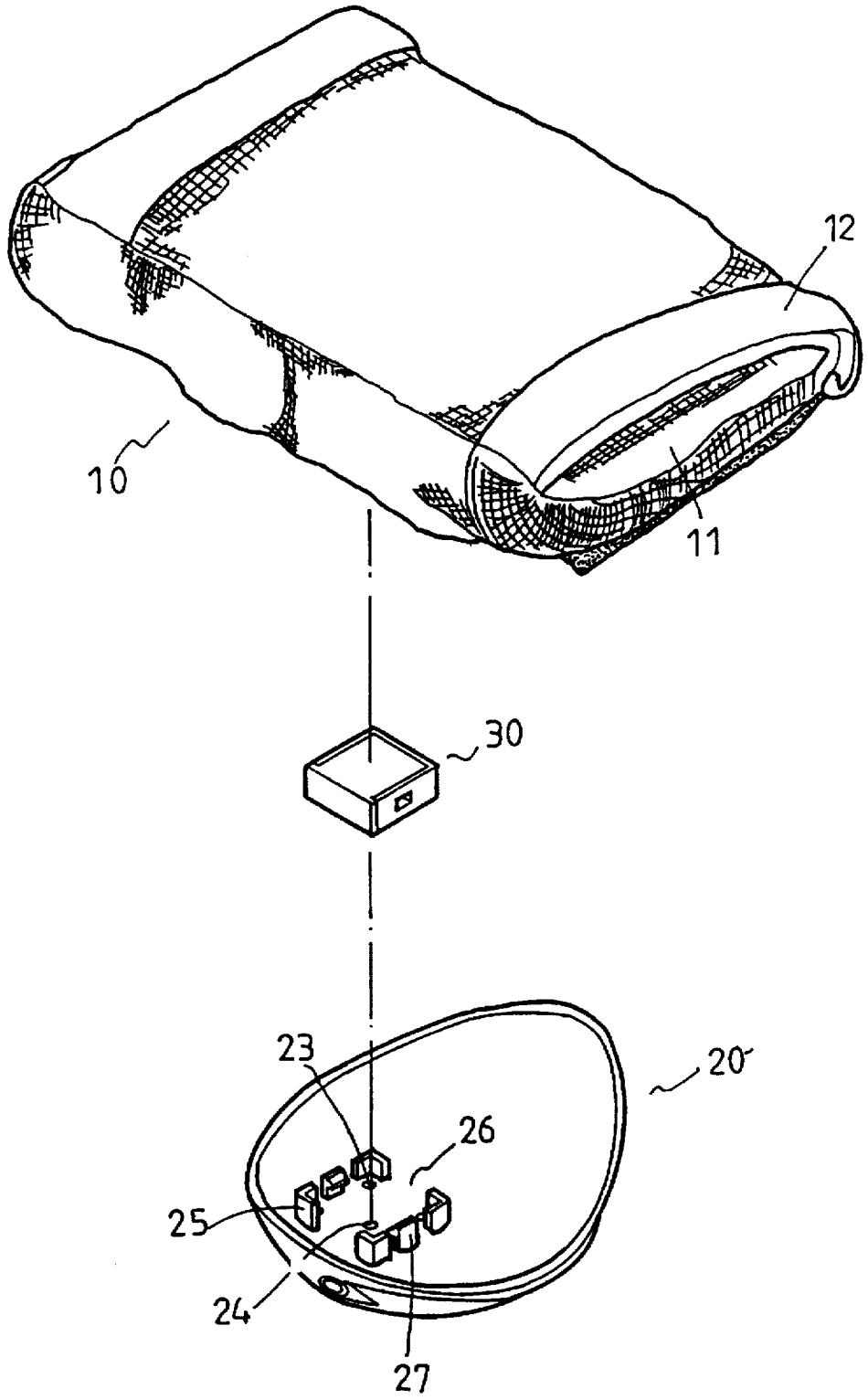
FIG. 2 is an exploded perspective view of the preferred embodiment of a protective elbow pad with a warning lamp signal device in the present invention.

A preferred embodiment of a protective elbow pad and a protective knee pad with a warning lamp signal device in the present invention, as shown in FIGS. 1 and 2, includes a tubular pad 10, an upper cover 20, and a warning lamp signal device 30 combined together.

The tubular pad 10 is made of elastic material, having an interior space 11 and a Velcro band 12 respectively around two opposite ends to be worn elastically and tightly on an elbow or a knee of a person.

The upper cover 20 is shaped to curve up properly, having two fasteners 21, 21 respectively on two lateral sides for fixing on the tubular pad 10, a top portion 22, several holes 23, 24 in the top portion 22, a plurality of angle posts 25 fixed on an inner surface so as to form a position hollow space 26, and two position hooks 2 formed between two angle posts 25, 25 located diagonally.

Figure 3:
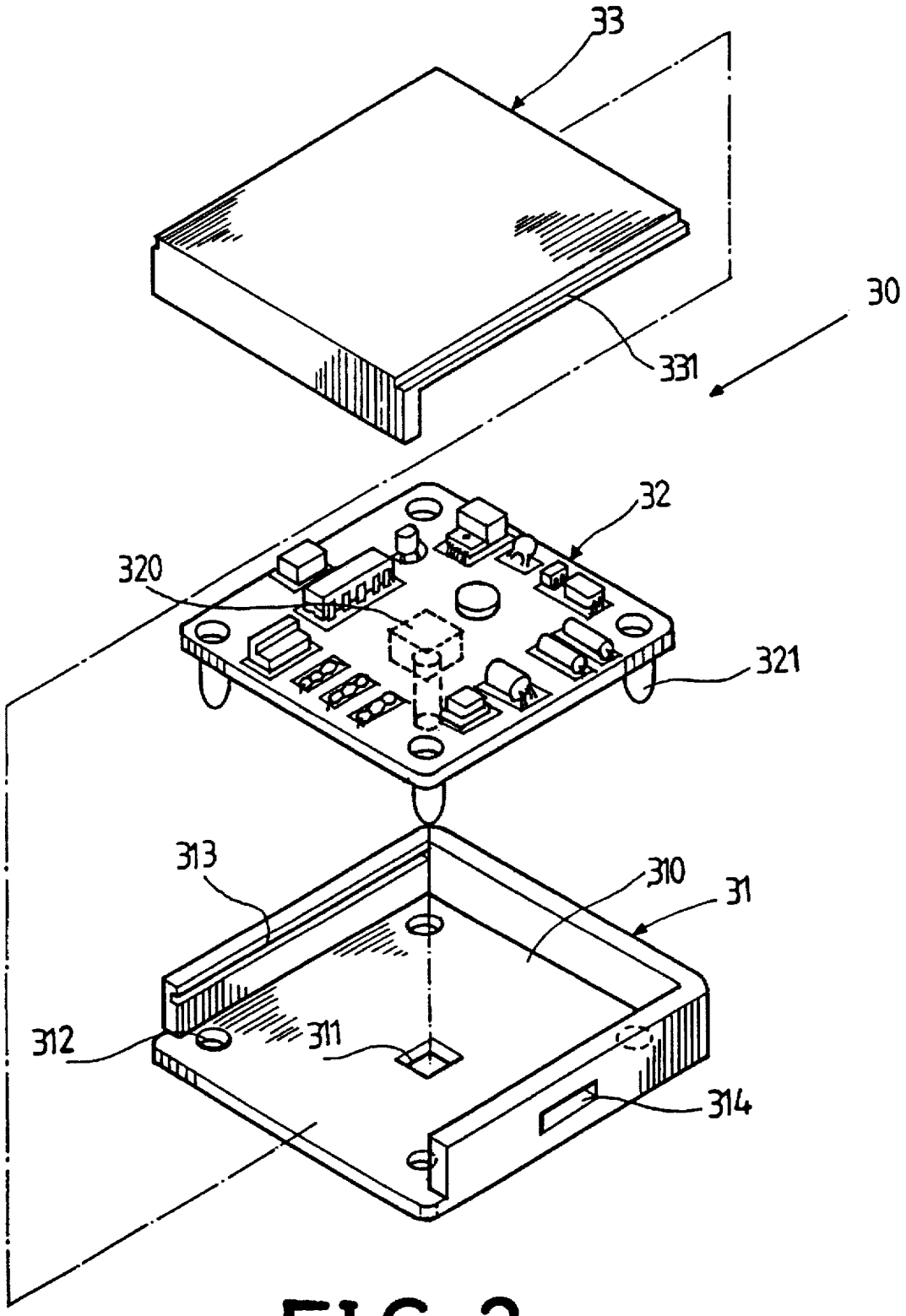
FIG. 3 is an exploded perspective view of a warning lamp signal device in the present invention.
Figure 4:
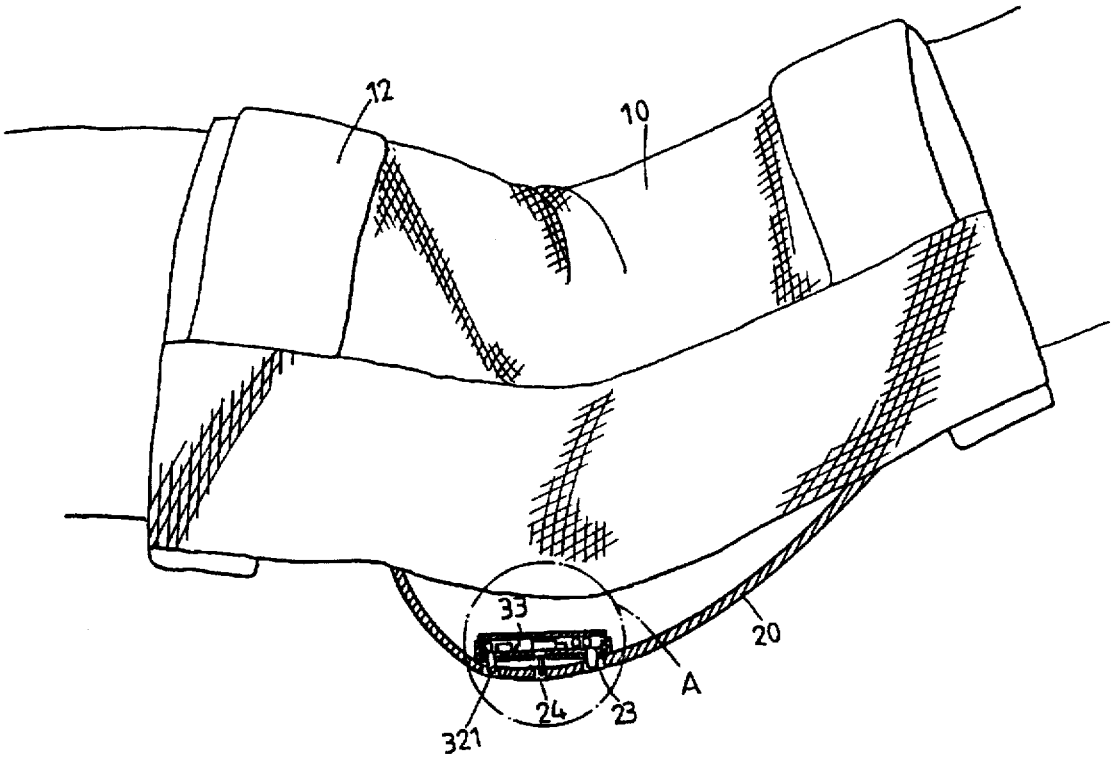
FIG. 4 is a perspective view of the preferred embodiment of a protective elbow pad with a warning lamp signal device in the present invention showing it worn on a person's elbow.
Figure 4A:
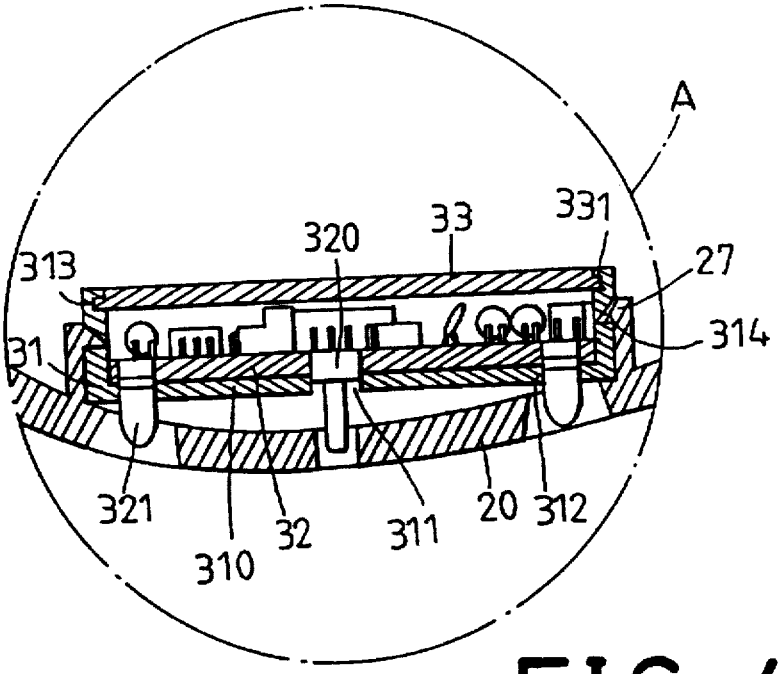
FIG. 4A is a magnified longitudinal sectional view of the preferred embodiment of a protective elbow pad with a warning lamp signal device in the present invention, showing the symbol A of the detail of a circuit board in the FIG. 4.
Figure 5:
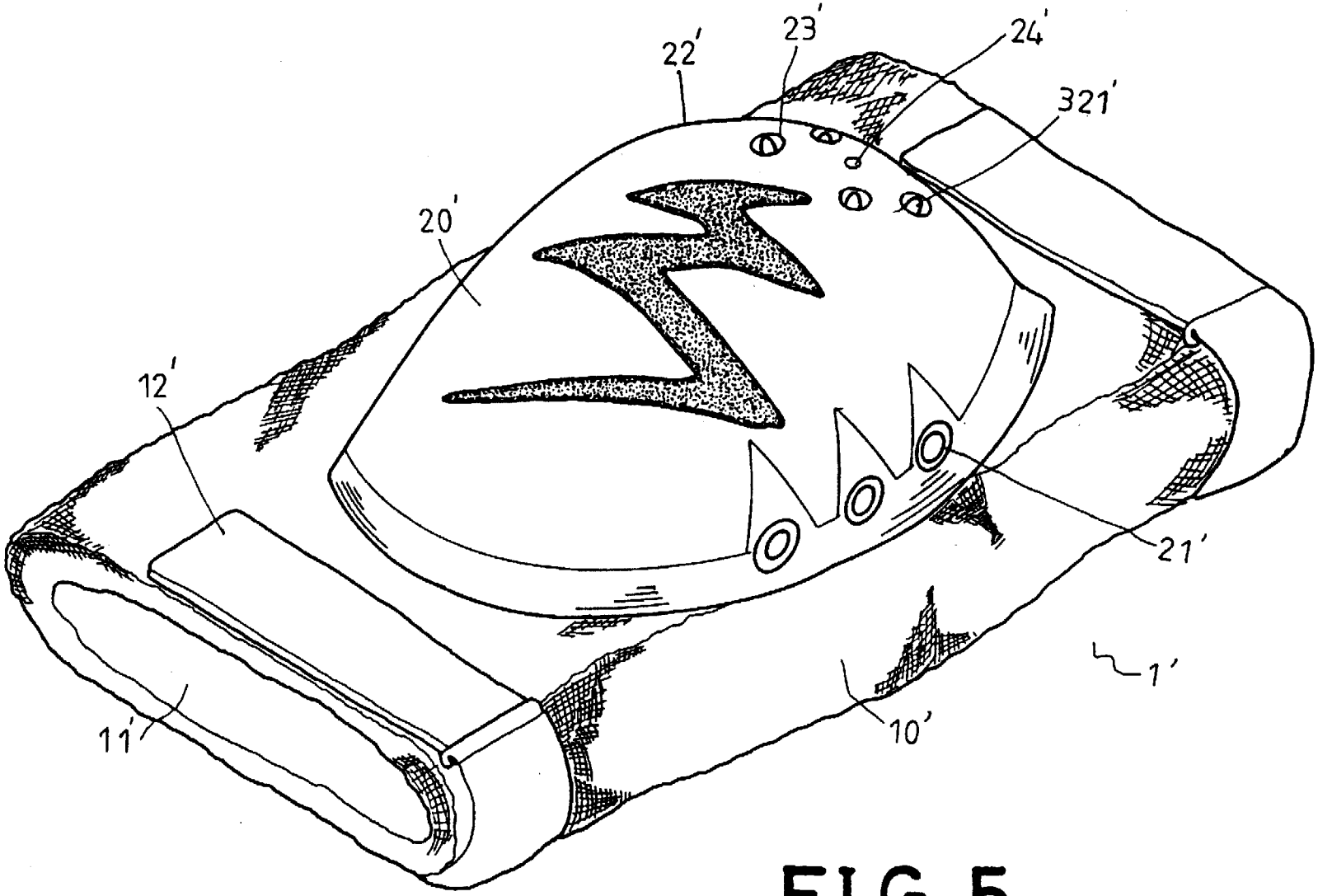
FIG. 5 is a perspective view of a preferred embodiment of a protective knee pad with warning lamp signal device in the present invention.
Figure 6A:
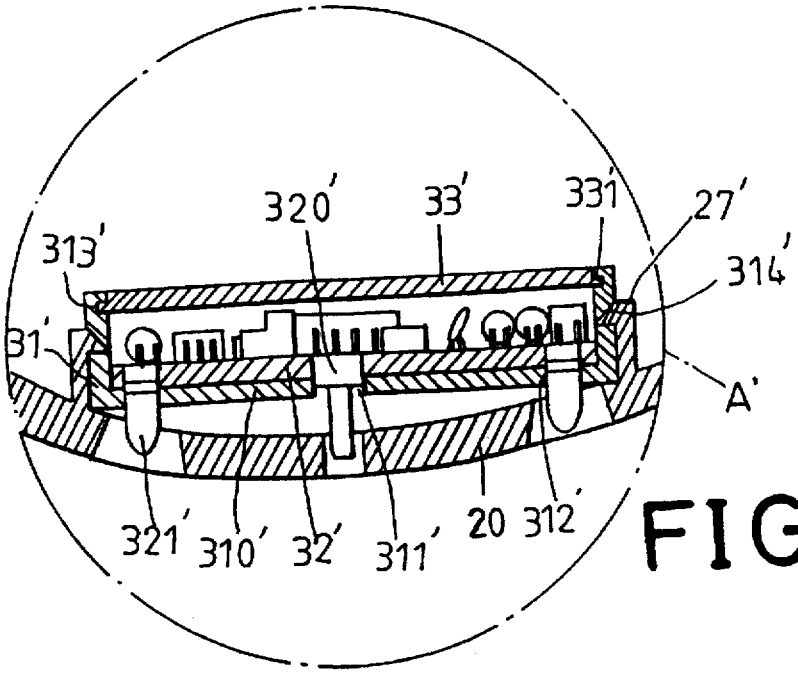
FIG. 6A is a magnified longitudinal sectional view of the preferred embodiment of a protective elbow pad with a warning lamp signal device in the present invention, showing the symbol A' of the detail of another circuit board in the FIG. 6.
Figure 6:
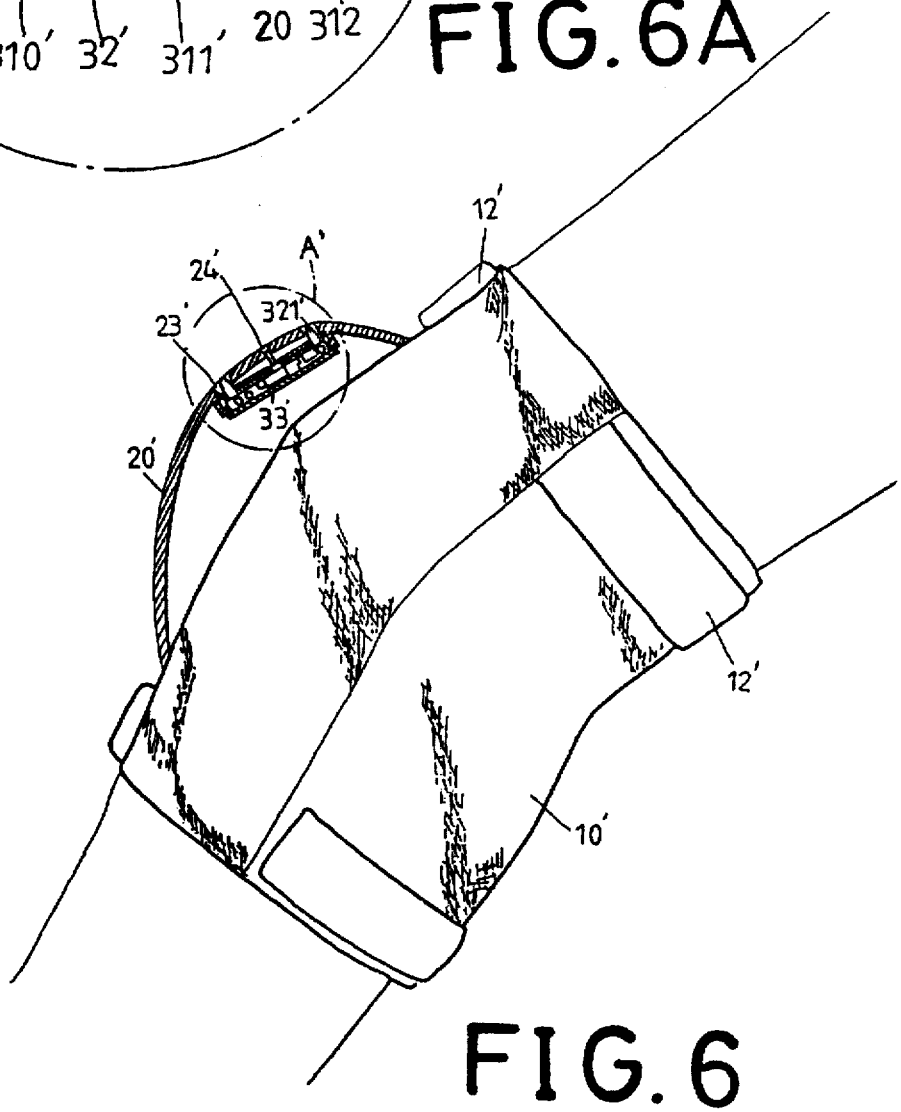
FIG. 6 is a perspective view of the preferred embodiment of a protective knee pad with a warning lamp signal device in the present invention showing it worn on a person's knee.

The warning lamp signal device 30, as shown in FIGS. 1, 2 and 3, includes a case 31, a circuit board 32, and a lid 33.

The case 31 has a closed bottom 310 and three vertical side walls, an open vertical side, and an open upper side. The bottom 310 has a square switch hole 311 in the center, several lamp holes 312 in corners, and a horizontal slide groove 313 in inner surfaces of two opposite vertical side and a slot 314 in a right vertical side.

The circuit board 32 has an electronic components fixed on an upper surface to form a lamp control circuit for lighting up plural lamps 321 fixed in the corresponding locations to the lamp holes 312 of the case 31, a switch 320 fixed in the corresponding location to the square hole 311 of the case 31.

The lid 33 is shaped as L, made of a thin plate, having a vertical wall 330 to close the open side of the case 31, and a stepped edge 331 respectively on the two side walls neighboring the side wall of the vertical wall 330.

Referring to FIGS. 4, 4A, 5, 6 and 6A in combining the protective elbow pad or a protective knee pad with a warning lamp signal device 30, the lamp 321 or 321' and the switch 320 or 320' are respectively inserted in the lamp holes 312 or 312' and a switch hole 311 or 311'. Then the lid 33 or 33' is combined with the case 31, with the stepped edges 331 or 331' engaging the slide grooves 313 or 313'. After that, the combined warning lamp signal device 30 or 30' is deposited in the position space 26 or 26' of the upper cover 20, 20' with the lamps 321 or 321' fitting in the lamp holes 23 or 23' of the upper cover 20, and with the switch 320 or 320' fitting in the hole 24 or 24', and with the hook 27 or 27' hooking the slot 314 or 314'. Then the warning lamp signal device 30 or 30' is secured in the hollow space 26, 26'. Finally, the upper cover 20 or 20' is secured in place with the fasteners 21 or 21' on the tubular pad 10 or 10'.

Figure 7:
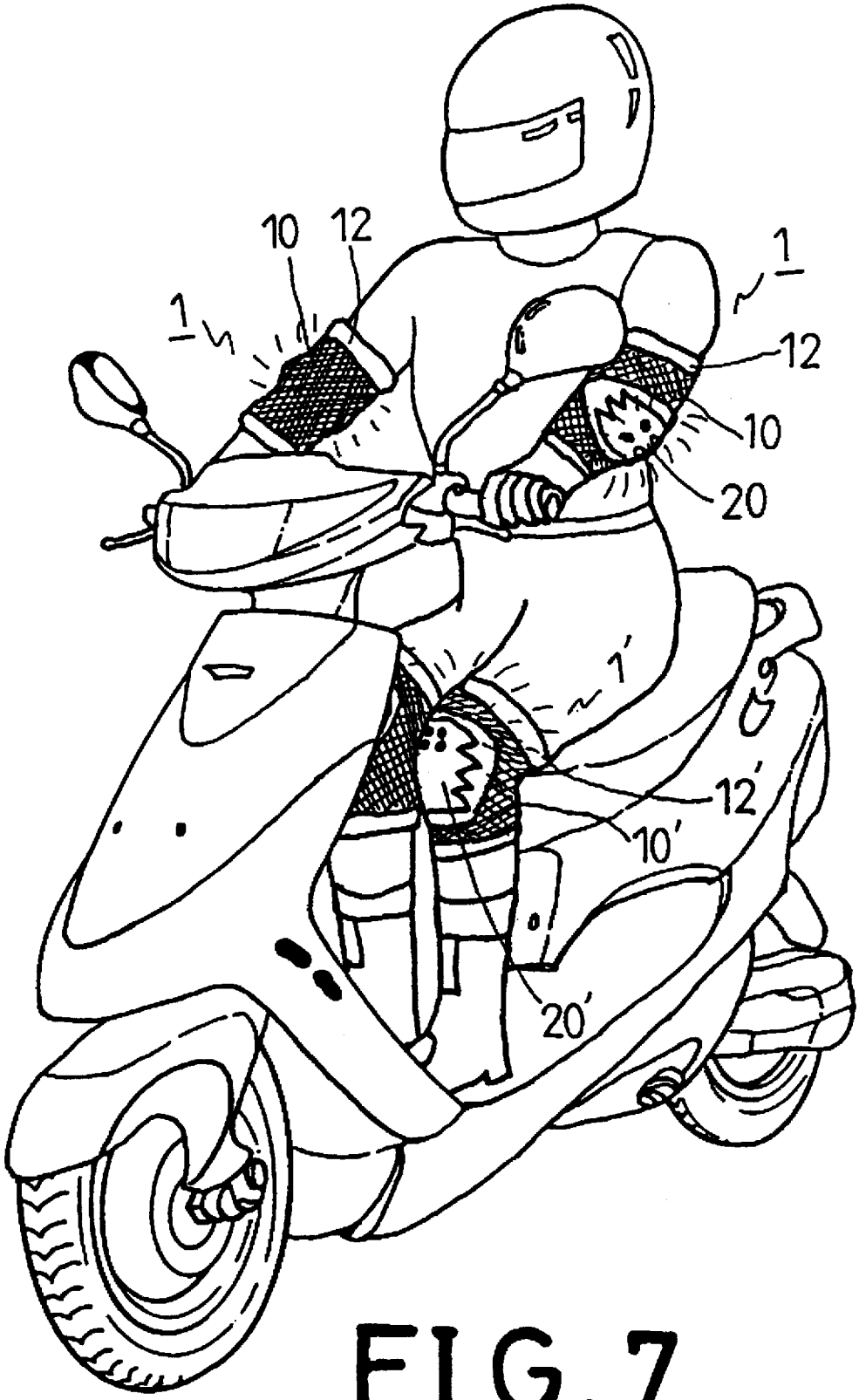
FIG. 7 is a perspective view of the protective elbow pad and the protective knee pad with a warning lamp signal devices in the present invention showing them worn on two elbows and two knees of a person riding a motorcycle; and, FIG. 8 is another perspective view of the protective elbow pad and the protective knee pad with a warning lamp signal devices in the present invention showing them worn on two elbows and two knees of a person.
Figure 8:
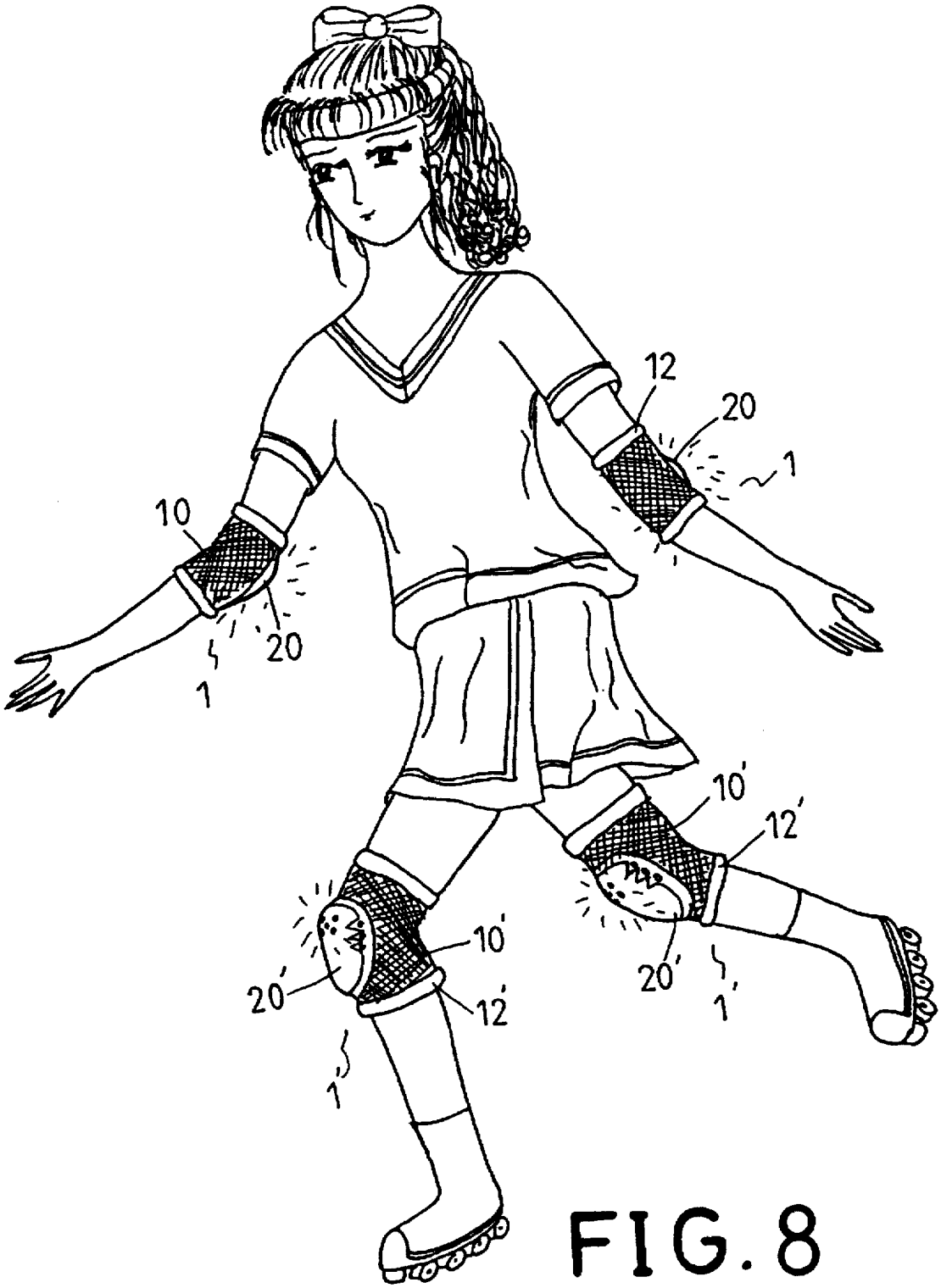

In using, referring to FIGS. 7 and 8, the protective elbow pad and the protective knee pad with the warning lamp signal device are worn on an elbow(s) and on a knee(s), and the the switches of the warning lamp signal devices are pressed with a pointed thing to light the lamps to flash giving warning to people around so that a user can be protected from hurting his/her elbow(s) and a knee(s). In addition, provided the user should fall down by an accident, he/she may be alleviated in harm with the protective elbow pad and the protective knee pad with the warning lamp signal device. Or people around the user may feel an accident being happening, and immediately take vigilant action beforehand.

While the preferred embodiment has been described above, and it will be recognized and understood that various modifications may be made therein and the appended claims are intended to cover all such modifications which may fall within the spirit and scope of the invention.

What is claimed is:

1. A protective elbow or knee pad with a warning lamp signal device, comprising a tubular pad, an upper cover and a warning lamp signal device;

said tubular pad having good elasticity, an inner hollow space for an elbow or a knee to fit therein, a Velcro band fixed respectively around two ends for securing said elbow or knee pad on an elbow or a knee;

said upper cover being shaped to curve up properly, having a top portion, fixed securely on said tubular pad by means of fasteners on two sides, a plurality of lamp holes and a switch hole in said top portion, a position space defined by a plurality of angle posts fixed on an inner surface, and a hook formed respectively near two of said angle blocks in a diagonal line;

said warning lamp signal device including a case, a circuit board and a lid combined together, said case preferrably shaped square and having a closed bottom side, an open upper side, three vertical side and one open vertical side, a square switch hole provided in the center of the bottom side, plural lamp holes provided in said bottom side, a horizontal slide groove formed respectively in an inner surface of two opposite vertical sides, and a slot bored in a right vertical side;

said circuit board having several electronic components and a circuit arranged on an upper surface, a switch fixed on the center thereof, plural lamps fixed to extend downward at locations corresponding to said lamp holes of said case;

said lid having a vertical downward side wall formed at one side, an engage edge formed on two sides neighboring said vertical side wall; and, characterized by said warning lamp signal being deposited in said position space defined by said angle posts by means of said hook of said upper cover hooking said slot of said case, and said switch and said lamps of said circuit board fitted in said lamp holes and said switch hole of said upper cover.

* * * * *